United States Patent [19]

Wallace

[11] 4,445,740

[45] May 1, 1984

[54] CIRCUIT BOARD ASSEMBLY

[75] Inventor: Keith L. Wallace, Marion, Iowa

[73] Assignee: Rockwell International Corporation, El Segundo, Calif.

[21] Appl. No.: 371,850

[22] Filed: Apr. 26, 1982

[51] Int. Cl.[3] ..... H01R 13/62

[52] U.S. Cl. ..... 339/45 M; 339/75 M

[58] Field of Search ..... 339/75 M, 45 M, 75 MP, 339/17 M, 45 R

[56] References Cited

U.S. PATENT DOCUMENTS

| | | | |
|---|---|---|---|
| T876,004 | 7/1970 | Andreini et al. | 339/75 M |
| 3,668,605 | 6/1972 | Albert | 389/75 M |
| 4,045,109 | 8/1977 | Langenbach et al. | 339/75 M |
| 4,083,616 | 4/1978 | McNiece | 339/45 M |
| 4,243,283 | 1/1981 | McSparran | 339/45 M X |
| 4,301,494 | 11/1981 | Jordan | 339/45 M X |
| 4,313,150 | 1/1982 | Chu | 339/45 M X |

*Primary Examiner*—William R. Briggs

*Attorney, Agent, or Firm*—Richard K. Robinson; George A. Montanye; H. Fredrick Hamann

[57] ABSTRACT

A circuit module and connector assembly includes a chassis assembly containing a mother board with a first conjugal connector for receipt of a circuit module having a second conjugal connector on one end and an insertion and extraction device mounted on the other end. The circuit module is vertically mounted into the chassis assembly and, with the use of the insertion and extraction device, is seated into a vertically mounted mother board that contains the first conjugal connector.

7 Claims, 8 Drawing Figures

CIRCUIT BOARD ASSEMBLY

BACKGROUND OF THE INVENTION

This invention relates to circuit module and connector assemblies and, in particular, to assemblies that include circuit modules having insertion and extraction devices.

Electronic equipment often includes one or more circuit modules that contain electronic components. The circuit modules are mounted in a chassis assembly by card edge type connectors that plug into conjugally matched connectors mounted within the chassis assembly, usually on what is referred to as a mother board. The mother board facilitates the interconnection between the different circuit modules. When the direction of insertion of the circuit modules into the chassis assembly is also the direction in which the conjugal connector on the circuit module can engage with the conjugal connector on the mother board then enough force can be applied to the circuit module to insure a good electrical contract between the two conjugally matched connectors. However, there are special applications where the conjugally matched connectors are at right angles to the direction of insertion of the circuit module into a chassis assembly. These applications are especially useful in that maximum resistance to moisture, dirt and humidity may be afforded to a vertical mounting of a side board connection.

SUMMARY OF THE INVENTION

A circuit module and connector assembly includes a chassis assembly containing a mother board with a first conjugal connector for receipt of a circuit module having a second conjugal connector on one end and an insertion and extraction device mounted on the other end. The circuit module is vertically mounted into the chassis assembly and, with the use of the insertion and extraction device, is seated into a vertically mounted mother board that contains the first conjugal connector.

There are several embodiments of the insertion and extraction device disclosed as well as an embodiment of a card cage assembly with multiple circuit modules having insertion and extraction devices mounted thereon.

It is the objective of this invention to provide a circuit module for vertically mounting into a chassis assembly with side board connection for maximum resistance to dust, moisture and humidity.

It is another objective of the invention to provide a chassis assembly for a circuit module and connector assembly that allows vertical insertion and extraction of circuit modules while requiring little extra space within the electronic chassis assembly for the circuit board insertion and removal.

It is yet another objective of the invention to provide a circuit module and chassis assembly that has a guidance means that facilitates insertion and extraction of the circuit protecting the conjugal connectors from damage.

It is yet another objective of the invention to provide a circuit module and chassis assembly that includes an insertion and extraction device that provides a cam assist for a mechanical advantage during the insertion and extraction procedures.

BRIEF DESCRIPTION OF THE DRAWINGS

In order that the invention may be readily carried into practice, a number of embodiments will now be described in detail by way of example, with reference to the accompanying drawings in which.

DETAILED DESCRIPTION OF THE PREFERRED EMBODIMENT

Figure 1:
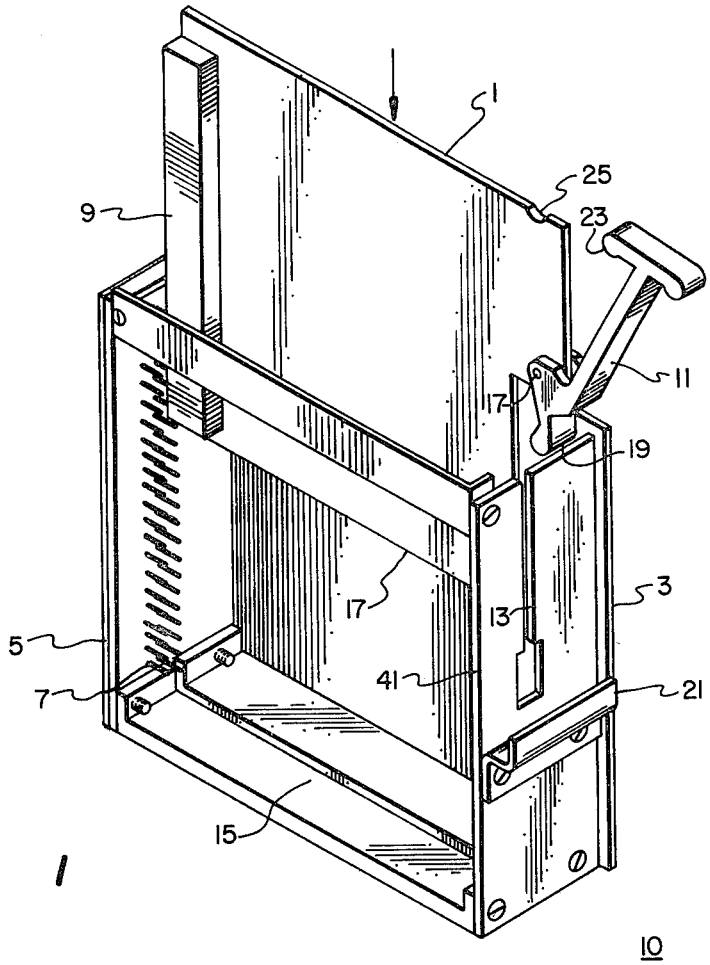
FIG. 1 is an illustration of a chassis assembly with a circuit module having an insertion and extraction device according to the invention.

In FIG. 1, to which reference should now be made, there is shown a circuit module such as a printed circuit board and a chassis assembly 10 that includes a circuit module 1 for mounting into the chassis assembly 3. The chassis assembly 3 has mounted in the side board position a mother board which contains a connector assembly 7 for receipt of a connector 9 mounted on the circuit module 1. To facilitate insertion and extraction, the circuit module 1 has an insertion and extraction member 11 mounted on the opposite side of module 1 and in parallel alignment with connection 9. The circuit module 1 is inserted into the chassis assembly and guided therein by means of the guide slots 13 and 15. When the bottom edge 17 of the circuit module 1 is nested in the guide slot 15, the insertion and extraction member 11 may be rotated around the fulcrum 17 causing a cam portion 19 of the insertion and extraction device 11 to come in contact with a brace 21 forcing the connector 9 to become engaged with the connector pin assembly 7. The connector 9 and the connector pin assembly 7 are conjugally matched to each other to facilitate proper conductor alignment. When completely inserted, a retaining lip 23 engages a retaining notch 25 that is present in the top of the circuit module 1 locking the insertion and extraction device 11 into a mated position retaining the connector 9 and the connector pin assembly 7 together.

Figure 2:
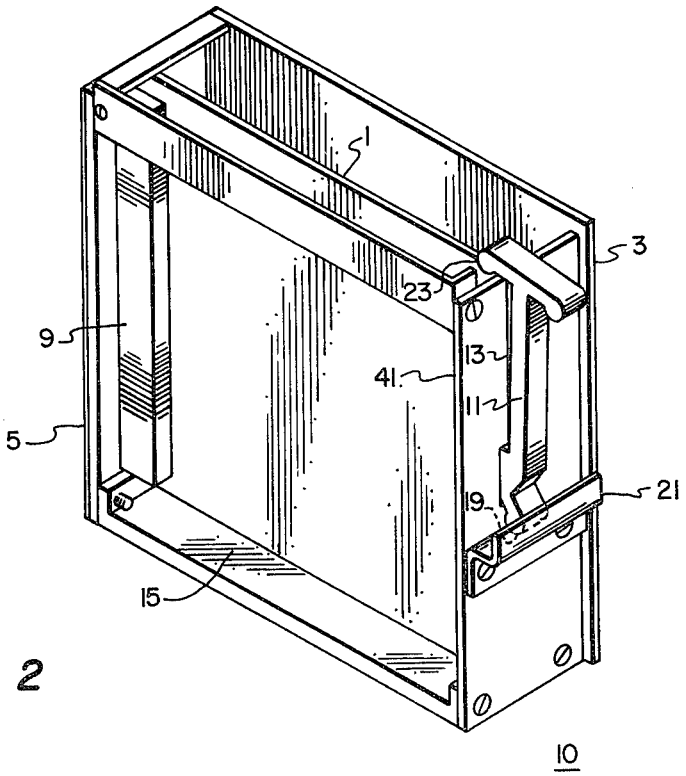
FIG. 2 is an assembled circuit module and chassis assembly according to the invention.

The mated position is illustrated in greater detail in FIG. 2, to which reference should now be made, in which the cam 19 is applying pressure against the brace 21 retaining the connector 9 in an engaged position with the pins that are art part of the connector pin assembly 7 as shown in FIG. 1.

Figure 3:
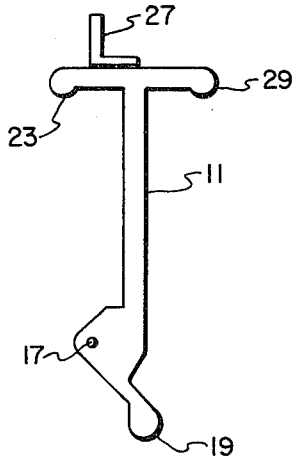
FIG. 3 is a side view of the insertion and extraction device.

FIG. 3, to which reference should now be made, is a side view of the insertion and extraction device 11 and illustrates a finger hold 29 for pulling on the insertion and extraction device 11 to cause the connector 9 to become disengaged from connector pin assembly 7. Additionally, the insertion and extraction device 11 also has a thumb press 27 for applying pressure on the insertion and extraction device 11 during insertion so that the retaining nodule 23 may become engaged with the retaining notch 25 that is located on the top notch of the circuit module 1.

Figure 4:
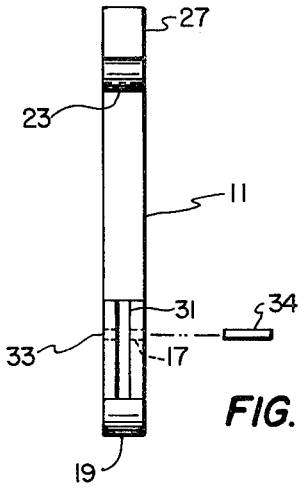
FIG. 4 is an end view of the insertion and extraction device of FIG. 3.

In FIG. 4, which is a side view of FIG. 3, there is shown a notch 31 to facilitate the mounting of the insertion and extraction device 11 onto the circuit module 1 retaining the insertion and extraction device 11 in the mounted position thereby. Also, there is shown the hole 33 which receives the pin 34 to form the fulcrum 17.

Figure 5:
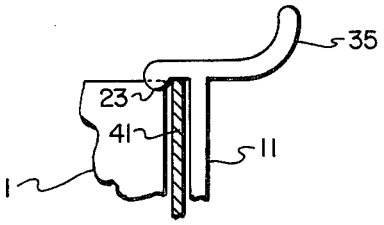
FIGS. 5, 6 and 7 are different embodiments of a thumb press of the insertion and extraction device according to the invention.
Figure 6:
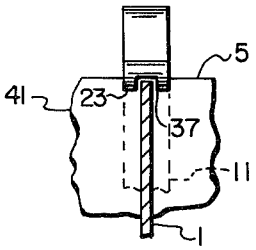

FIG. 5 illustrates a combination finger pull and thumb press embodiment of the insertion and extraction device 11. Additionally, the nodule 23 is designed such that it latches onto the end of the chassis assembly. This embodiment is shown more clearly in FIG. 6 wherein there is a clearance notch 37 to provide clearance of the circuit module 1 but yet allow the notch 23 to latch on the side 41 of the chassis assembly 5.

Figure 7:
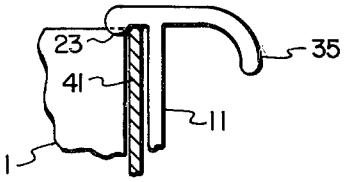

FIG. 7 illustrates yet another embodiment of the finger press and thumb pull 35 which is designed to curve downward versus the curvature of the upward thumb press and finger pull 35 that was illustrated in FIG. 5.

Figure 8:
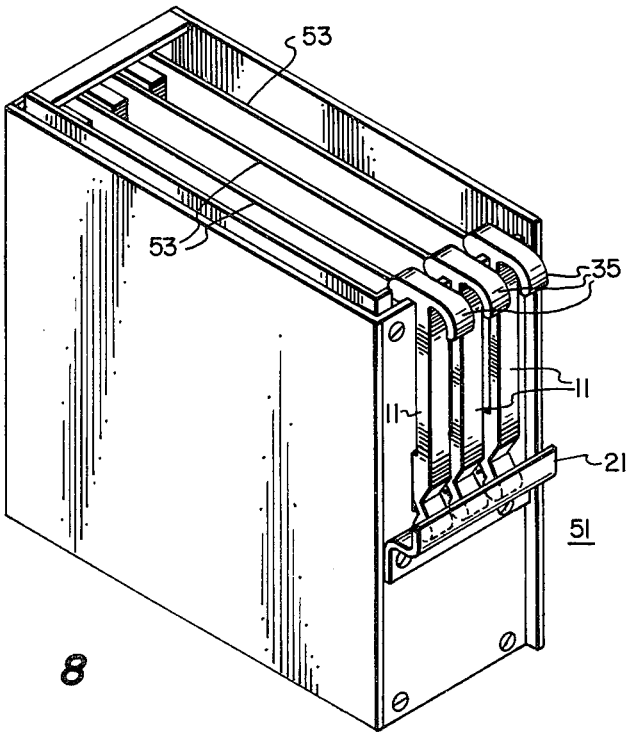
FIG. 8 is a multiple module chassis assembly according to the invention.

FIG. 8 shows an embodiment of a chassis assembly that is a multiple card cage 51 that has a plurality of circuit modules 53 mounted therein. Each circuit module 53 has an insertion and extraction device 11 to facilitate the insertion and extraction of the circuit modules. The close proximity of the modules and the fact that the width of the chassis need only be enough to allow clearance of the connector pin assembly 7 should be noted.

The channel shape of the chassis assemblies 3 of FIG. 1 and 51 of FIG. 5 enhances the overall strength of the chassis assemblies without extra material or weight.

Many changes and modifications in the above described invention can, of course, be carried out without departing from the scope thereof. Accordingly, the invention is intended to be limited only by the scope of the appended claims.

I claim:

1. A circuit board coupling assembly comprising:

a circuit board receiving assembly having first and second planar sides in opposed spaced relation generally parallel to one another and coupled by a third planar side extending between said first and second side to form a generally U-shaped channel;

a plurality of first electrical terminals positioned along said first side within said channel;

a planar circuit board having first, second and third edges, said first and second edges being generally parallel to one another and said third edge extending generally perpendicular to said first and second edges, said first edge having a plurality of second electrical terminals extending therealong in a configuration matching that of said first electrical terminals along said first side, said circuit board being slidably received between said first and second sides such that said first and second edges slide parallel to and adjacent said first and second sides, respectively, and said third edge slides into adjacent parallel abutting relationship with said third side; and means for moving said circuit board in a direction perpendicular to the plane of said first and second sides to cause engagement and disengagement of said first and second electrical terminals.

2. The apparatus of claim 1 wherein said means for moving comprises:

a lever having first and second ends and an intermediate portion coupling said first and second ends; and means for pivotally coupling said intermediate portion to said second edge.

3. The assembly of claim 1 wherein said second side includes a member which engages said first end of said lever such that upon movement of said second end of said lever, said circuit board moves in said perpendicular direction.

4. A circuit module comprising:

a housing having first and second opposed side portions spaced parallel to one another and coupled by a third side portion to form a generally U-shaped channel;

a generally rectangular circuit board having first and second edges extending generally parallel to one another, and third and fourth edges extending perpendicularly between said first and second edges, said circuit board being slidably received between said first and second side portions by parallel movement of said first and second edges adjacent said first and second side portions to a position where said third edge lies parallel to and adjacent said third side portion;

a plurality of first electrical terminals coupled to said first side portion in a predetermined configuration within said channels;

a plurality of second electrical terminals coupled to said one edge in the same predetermined configuration as said first electrical terminals; and means for moving said circuit board in a direction perpendicular to said first and second side portions to cause engagement and disengagement of said first and second terminals.

5. A circuit board coupling assembly comprising:

a connector chassis assembly having first and second opposed sides spaced from one another;

at least one first electrical terminal coupled to said first side;

a circuit board having opposed edges and at least one second electrical terminal coupled to one of said edges, said circuit board being slidably received between said first and second sides by slidable movement of said edges parallel to said sides; and means for moving said circuit board edges perpendicular to said sides such that said at least one second electrical terminal engages said at least one first electrical terminal in a first position and disengages in a second position.

6. The apparatus of claim 5 wherein said at least one first and second electrical terminals are each a plurality of coupling terminals.

7. The apparatus of claim 5 wherein said means for moving comprises a lever arm having first and second ends, said lever arm being mounted for pivotal movement on said other edge of said circuit board at a position intermediate said first and second end and wherein said second side includes means for engaging said first end of said lever arm such that movement of said second end causes movement of said circuit board to engage and disengage said at least one first and second electrical terminals.

* * * * *